United States Patent [19]

Wassenhoven

[11] Patent Number: 4,689,946

[45] Date of Patent: Sep. 1, 1987

[54] SPINNING DEVICE FOR PRODUCING A TWISTED THREAD

[75] Inventor: Heinz-Georg Wassenhoven, Möchengladbach, Fed. Rep. of Germany

[73] Assignee: W. Schlafhorst & Co., Mönchengladbach, Fed. Rep. of Germany

[21] Appl. No.: 832,046

[22] Filed: Feb. 21, 1986

[30] Foreign Application Priority Data

Feb. 22, 1985 [DE] Fed. Rep. of Germany ..... 3506254

[51] Int. Cl.[4] ..... D01H 7/885

[52] U.S. Cl. ..... 57/301; 57/401

[58] Field of Search ..... 57/401, 400, 406, 407, 57/301

[56] References Cited

U.S. PATENT DOCUMENTS

| | | | |
|---|---|---|---|
| 3,911,660 | 10/1975 | Stalder | 57/407 |
| 4,315,398 | 2/1982 | Parker et al. | 57/401 |
| 4,380,892 | 4/1983 | Parker et al. | 57/401 |
| 4,399,650 | 8/1983 | Parker et al. | 57/401 |
| 4,537,022 | 8/1985 | Stahlecker | 57/401 |

*Primary Examiner*—Billy S. Taylor
*Assistant Examiner*—Joseph J. Hail, III
*Attorney, Agent, or Firm*—Herbert L. Lerner; Laurence A. Greenberg

[57] ABSTRACT

Spinning device for producing a twisted thread of spinning fibers, the device having two friction elements rotatable in the same rotary direction and with mutually parallel rotational axes, and a position varying device for permitting the friction elements to be brought temporarily into another position relative to one another for cleaning purposes and including constructive members in the position varying device for assuring constant parallelism of the rotational axes.

4 Claims, 7 Drawing Figures

SPINNING DEVICE FOR PRODUCING A TWISTED THREAD

The invention relates to a spinning device for producing a twisted thread and, more particularly, to such a device having friction elements rotatable in the same rotary direction and with mutually parallel rotational axes, and provided with a position varying device which permits the friction elements to be brought temporarily into another position relative to one another for cleaning purposes.

In such a spinning device, one of the rotatable friction elements is formed, for example, of a perforated drum which has in the interior thereof a suction device with a suction opening extending substantially parallel to the rotational axis of the friction element. The other of the rotatable friction elements can be constructed exactly like the one rotatable friction element. It can, however, also be formed of a simple drum or roller without any suction device.

The friction elements rotate in mutual close relationship forming two nips one of which serves as a spinning nip. Spinning fibers are introduced into the spinning nip, and a twisted thread is continuously drawn out of the spinning nip in a direction parallel to the rotational axes and then wound.

Besides spinning fibers, a continuous thread can also be fed in by the rear end thereof and can be covered or sheathed with spinning fibers so that a twisted thread, in turn, results.

Depending upon the spinning velocity, the fiber material which is used, the degree of impurities as well as other reasons, dirt and fiber accumulations can gather in the spinning nip and must be removed periodically. Such accumulations also form at the end of a spinning operation so that, before every repeated spinning operation, a cleaning is indicated.

It has already become known heretofore to swing one of the friction elements away from the other friction element about a pivot axis which is disposed transversely to the rotational axis. A disadvantage thereof is that if the swung-away friction element is brought back to its original position after the cleaning, the parallelism of the rotational axis of both of the friction elements may no longer be assured. Nonparallel rotational axes result, however, in an impairment of the spinning result and in increased disturbances or disruptions.

It is accordingly an object of the invention to provide a spinning device of the foregoing general type which provides remedies for and avoids disruptions due to nonparallelism of the rotational axes.

With the foregoing and other objects in view, there is provided, in accordance with the invention, a spinning device for producing a twisted thread of spinning fibers, the device having two friction elements rotatable in the same rotary direction and with mutually parallel rotational axes, and a position varying device for permitting the friction elements to be brought temporarily into another position relative to one another for cleaning purposes, comprising constructive means in the position varying device for assuring constant parallelism of the rotational axes. Several of such constructive means are proposed.

In accordance with another feature of the invention, the position varying device includes bearing elements variable in position relative to a machine frame, at least one of the two friction elements being mounted in the bearing elements, the bearing elements having at least one device for assuring synchronous movement thereof.

In accordance with a further feature of the invention, at least one of the two friction elements is rotatably mounted in swivel arms, the swivel arms being pivotable, in turn, about an axis parallel to the rotational axis of the other friction element.

In accordance with an alternate feature of the invention, at least one of the two friction elements is rotatably mounted in swivel arms, the swivel arms being pivotable, in turn, about the rotational axis of the other friction element.

In accordance with a further feature of the invention, the bearing elements and the swivel arms, respectively, have a common driving device for assuring synchronous movement thereof.

In accordance with an added feature of the invention, the bearing elements and the swivel arms, respectively, are movable by synchronously parallel running step-by-step motors.

If the spatial arrangement permits, a simpler construction is possible, in accordance with an additional feature of the invention, wherein the bearing elements and the swivel arms are connected to one another by a rigid bridge. In this case, no special electrical or electronic control devices are necessary to assure the parallelism of the rotational axes.

In accordance with a concomitant feature of the invention, the bearing elements are formed of commonly and synchronously movable eccentrics.

Other features which are considered as characteristic for the invention are set forth in the appended claims.

Although the invention is illustrated and described herein as embodied in a spinning device for producing a twisted thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
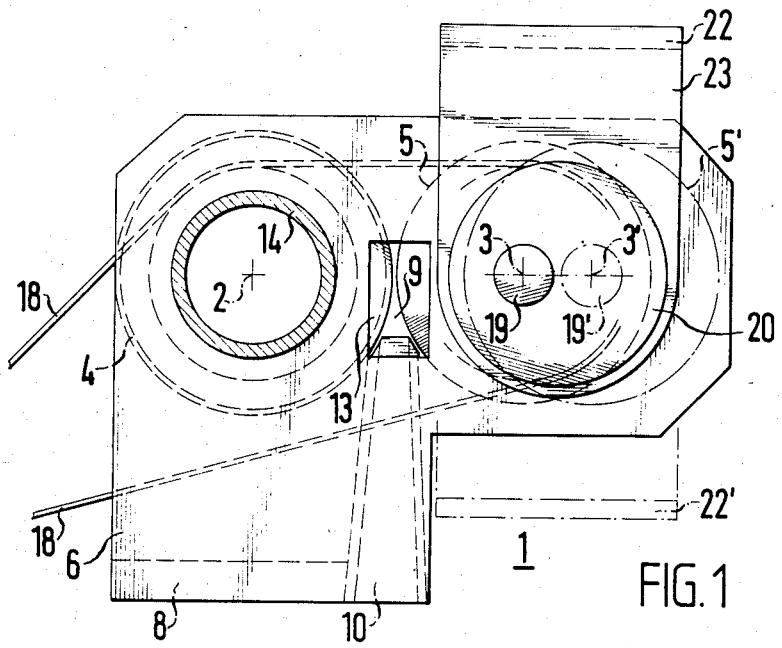
FIG. 1 is a front elevational view, partly in section, of one embodiment of a spinning device according to the invention.
Figure 2:
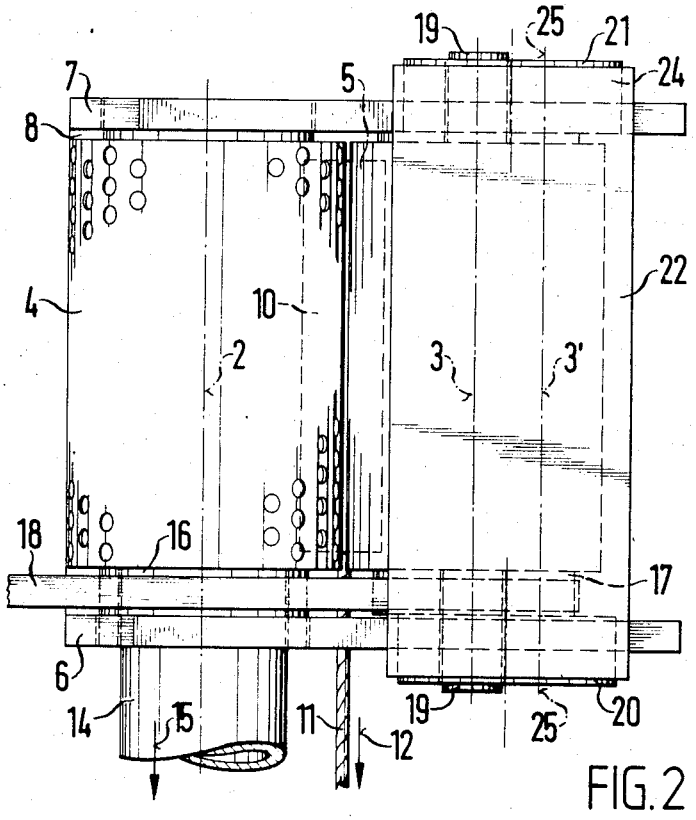
FIG. 2 is a top plan view of FIG. 1.

Referring now to the drawing and, first, particularly to FIGS. 1 and 2 thereof, there is shown a first embodiment of a spinning device 1 according to the invention having two friction elements 4 and 5 which have mutually parallel rotational axes 2 and 3 and are rotatable in the same rotary direction. The friction elements 4 and 5 are rotatably mounted in side walls 6 and 7 of a machine frame. The side walls 6 and 7 are connected by a base plate 8 into a rigid unit.

The friction elements 4 and 5 rotate so closely to one another that a spinning nip 9 is formed therebetween into which spinning fibers are fed with the aid of a fiber feed channel 10. A thread 11 which forms in the spinning nip 9 is withdrawn in the direction of an arrow 12 continuously through a window 13 formed in the side wall 6 and simultaneously wound into a coil. The conventional means for performing these operations have not been illustrated in the interest of clarity.

The friction element 4 is formed of a perforated drum having in the interior thereof a suction device with at least one suction opening extending substantially parallel to the rotational axis. The suction opening is directed opposite to the spinning nip or wedge 9. The suction device includes a suction tube 14 through which the suction air flowing in direction of the arrow 15 is discharged.

Behind the side wall 6 is a pulley 16 connected to the friction element 4 and having an endless belt 18 looped around it.

The other friction element 5 has the shape of a roller which is secured on a shaft 19. The shaft 19 is mounted in two bearing changing devices 20 and 21. Such bearing changing devices include bearing elements which are variable in position or location relative to the machine frame 6,7. Both elements are constructed as eccentrics. The eccentric 20 is in the forward side wall 6, and the eccentric 21 in the rear side wall 7.

The eccentrics 20 and 21 have constructive means in the shape of a rigid bridge 22 with two side brackets 23 and 24 for ensuring constant parallelism of the rotational axes 2 and 3. The side bracket 23 is connected to the eccentric 20, and the side bracket 24 to the eccentric 21.

Behind the forward side wall 6, the shaft 19 carries a pulley 17 which is likewise looped about by the aforementioned belt 18. Both friction elements 4 and 5 are driven in the same rotational direction by the belt 18.

Should the friction element 5 be removed from the friction element 4 for cleaning purposes the bridge 22 is then brought into the position 22' thereof. The friction element 5 then assumes the position 5', the shaft 19 the position 19', and the rotational axis 3 the position 3'. Both eccentrics 20 and 21 rotate about the axis 25. In every position of the friction element 5, the parallelism of the rotational axis 3 thereof to the rotational axis 2 of the other friction element 4 is assured.

Figure 3:
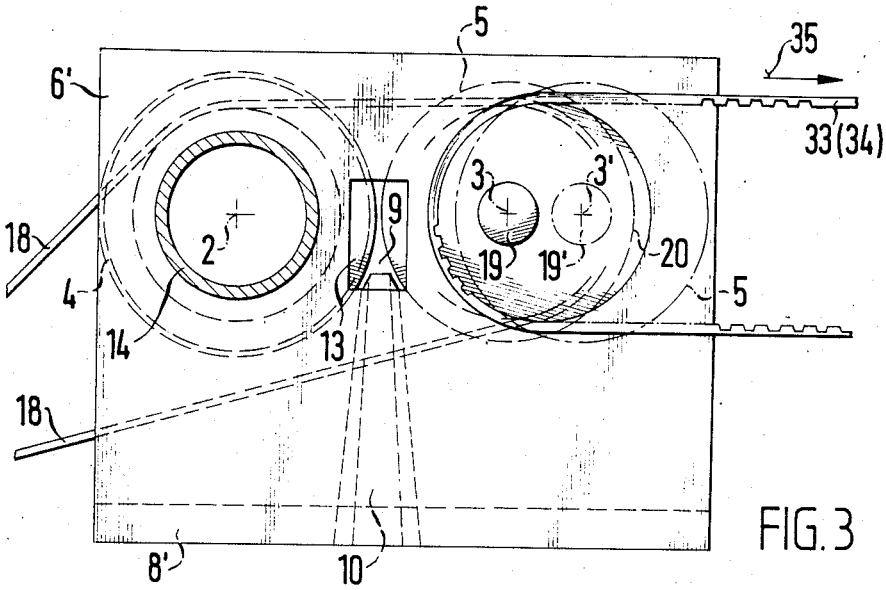
FIG. 3 is a view like that of FIG. 1 or another embodiment of the spinning device.
Figure 4:
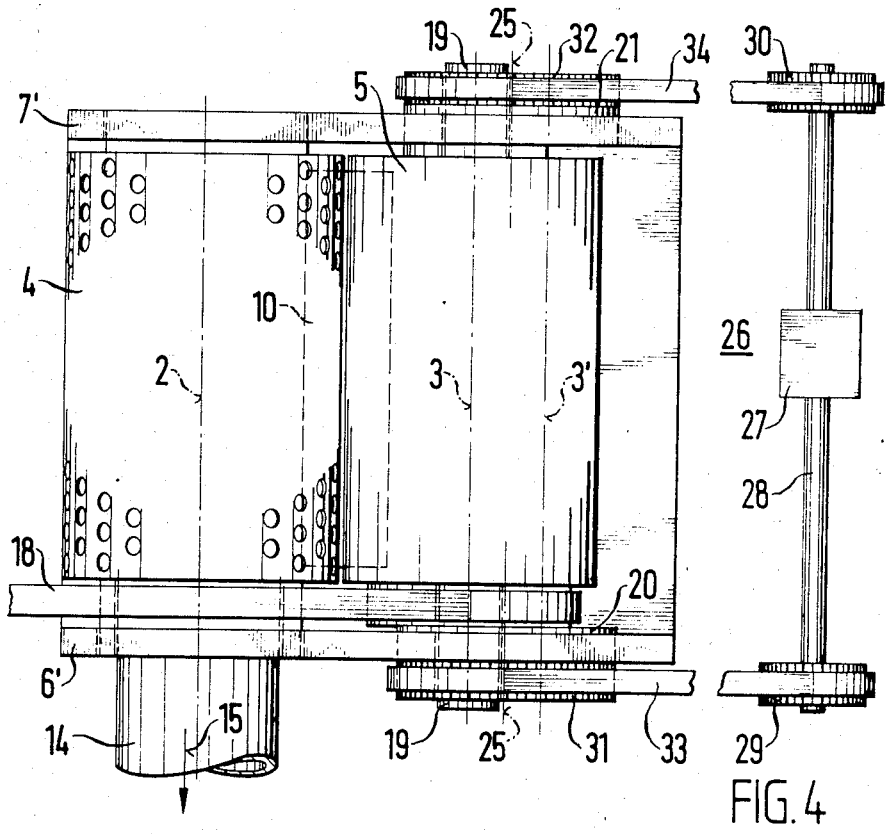
FIG. 4 is a top plan view of FIG. 3.

The second embodiment of the invention according to FIGS. 3 and 4 differs from the first embodiment according to FIGS. 1 and 2 by the following:

The side walls 6' and 7' of the machine frame and the base plate 8' are somewhat larger than for the embodiment according to FIGS. 1 and 2. Those constructive means which assure constant parallelism of the rotational axes 2 and 3 are constructed differently in this embodiment and, in fact, in the following manner:

Both eccentrics 20 and 21 have a common driving device identified as a whole by reference numeral 26, which assures the synchronous movement thereof. The driving device 26 has a transmission motor 27 which can rotate both in clockwise and counterclockwise direction. Gears 29 and 30 are located at the respective ends of the shaft 28. Both gears 29 and 30 are in alignment with gears 31 and 32, respectively. The gear 31 is secured to the eccentric 20, and the gear 32 to the eccentric 21. Endless chainlike tractive means 33 are looped about the gears 29 and 31, and similar tractive means 34 about the gears 30 and 32.

If the friction element 5 is to be moved forward from the friction element 4 for the purpose of cleaning, the transmission motor 27 is switched on, whereby the two tractive means 33 and 34 are moved, for example, in direction of the arrow 35 (FIG. 3) until the rotational axis 3 has attained the position 3' thereof, the shaft 19 the position 19' thereof and the friction element 5 the position 5' thereof.

After the cleaning, both tractive means 33 and 34 are moved back opposite to the direction of the arrow 35 by switching the transmission motor 27 over, until the rotational axes 2 and 3 have again attained the same spacing therebetween as shown in FIGS. 3 and 4. Also, thereby, the parallelism of the rotational axes 2 and 3 is assured in every position of the friction element 5.

Figure 5:
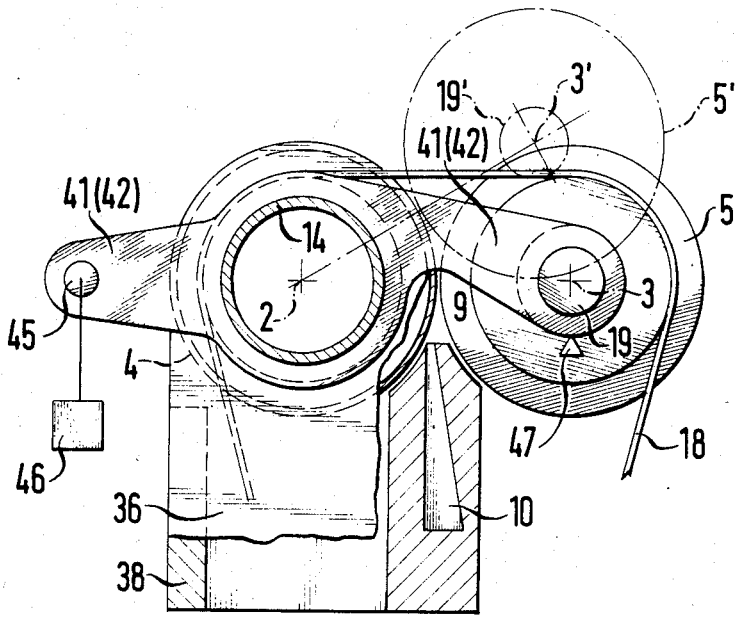
FIG. 5 is another view like that of FIG. 1 of a third embodiment of the invention.
Figure 6:
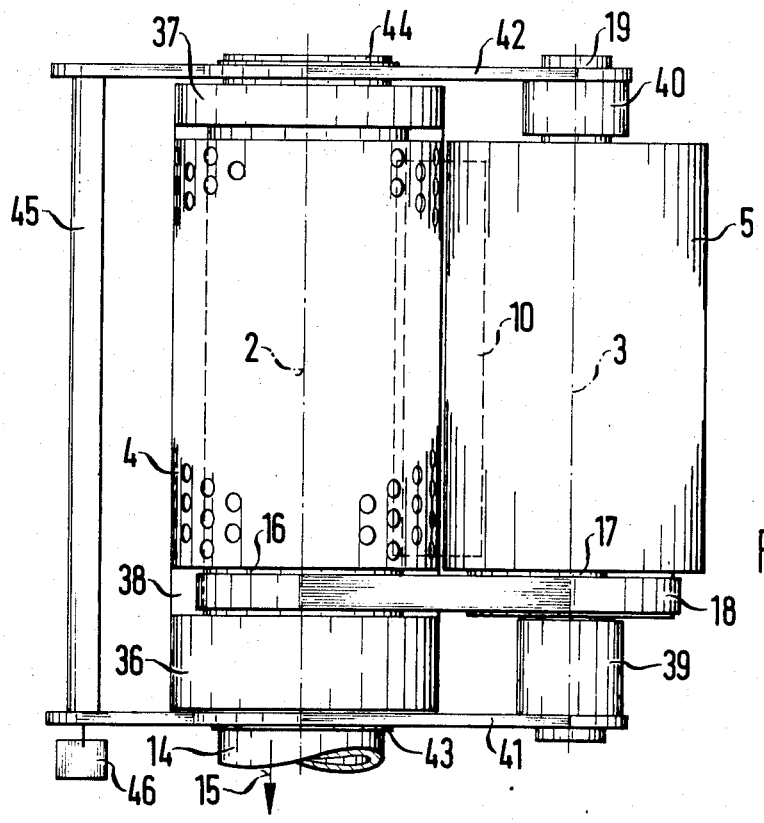
FIG. 6 is a top plan view of FIG. 5.

A third embodiment of the invention as shown in FIGS. 5 and 6, differs from the first embodiment of FIGS. 1 and 2 by the following:

Both side walls 36 and 37 of the machine frame are not connected by a base plate in this embodiment, but rather by a side plate 38. The shaft 19 of the friction element 5 is mounted in bearings 39 and 40. The bearing 39 is fastened to a swivel arm 41, and the bearing 40 to a swivel arm 42. Both swivel arms 41 and 42 are pivotable about the rotational axis 2 of the other friction element 4. A bearing 43 is provided on the suction tube 14 for the swivel arm 41, and a bearing 44 on the side wall 37 for the swivel arm 42, in order to permit the swivel arms 41 and 42 to be thus pivoted or swivelled.

Both of the swivel arms 41 and 42 are rigidly connected by a bridge 45 at the ends thereof facing away from the friction element 5.

If the spinning nip 9 is to be exposed for cleaning purposes, it is necessary only to lower the bridge 45 until the rotational axis 3 assumes the position 3' thereof, the shaft 19 the position 19' thereof, and the friction element 5 the position 5' thereof. In every position of the friction element 5, the parallelism of the rotational axes 2 and 3 is also assured thereby. The mutual spacing thereof is also not changed with this construction. The swivel arms 41 and 42 can be pivoted or swivelled manually or by a common driving device 46. By symbolically represented stops 47, assurance is provided that the swivel arms 41 and 42, after swinging back, again assume the original positions thereof exactly.

Figure 7:
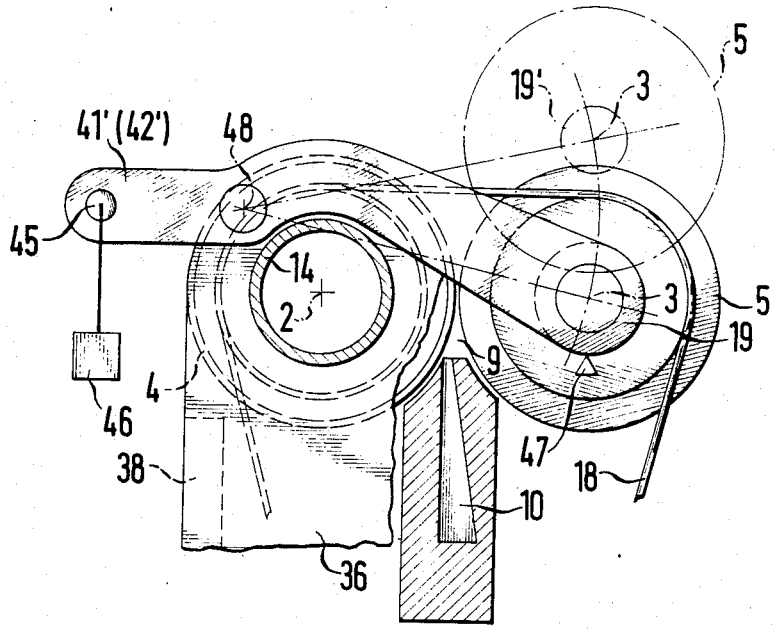
FIG. 7 is a view like that of FIG. 1 of a fourth embodiment of the invention.

A fourth embodiment of the invention according to FIG. 7 differs from the embodiment of FIGS. 5 and 6 by the following:

Both swivel arms 41' and 42' are not pivotable in FIG. 7 about the rotational axis 2, but rather about an axis 48 parallel to the rotational axis.

If the spinning nip 9 is to be exposed for cleaning purposes, it is necessary only to lower the bridge 45 until the rotational axis 3 assumes the position 3', the shaft 19 the position 19', and the friction element 5 the position 5'. The friction element 5 then sets the spinning nip 9 free and is located at a greater axial spacing from the friction element 4.

As mentioned hereinbefore, the invention is not limited to the illustrated and described embodiments. As an alternative to the second embodiment of the invention as shown in FIGS. 3 and 4, instead of a single transmission motor 27, two individual, synchronously parallel running step-by-step motors are used, of which each drives the two gears 29 and 30.

There is claimed:

1. Spinning device for producing a twisted thread of spinning fibers, the device having two friction elements rotatable in the same rotary direction and with mutually parallel rotational axes, and a position varying device for permitting the friction elements to be brought temporarily into another position relative to one another for cleaning purposes, comprising constructive means in the position varying device for assuring constant parallelism of the rotational axes, at least one of the two friction elements being rotatably mounted in swivel arms, said swivel arms being pivotable, in turn, about the rotational axis of the other friction element.

2. Spinning device according to claim 1, wherein said position varying device includes bearing elements variable in position relative to a machine frame, at least one of the two friction elements being mounted in said bearing elements, said bearing elements having at least one device for assuring synchronous movement thereof.

3. Spinning device according to claim 2, wherein said bearing elements and said swivel arms, respectively, have a common driving device for assuring synchronous movement thereof.

4. Spinning device according to claim 2, wherein said bearing elements and said swivel arms are connected to one another by a rigid bridge.

* * * * *